United States Patent [19]

Preston et al.

[11] 4,044,779

[45] Aug. 30, 1977

[54] MANUFACTURE OF FILTER-TIPPED CIGARETTES

[75] Inventors: Edward George Preston; Jan Antoni Rakowicz, both of London, England

[73] Assignee: Molins Limited, England

[21] Appl. No.: 630,517

[22] Filed: Nov. 10, 1975

[30] Foreign Application Priority Data

Nov. 15, 1974 United Kingdom ..... 49420/74

[51] Int. Cl.[2] ..... A24C 5/343; A24C 5/52

[52] U.S. Cl. ..... 131/21 R; 131/94

[58] Field of Search ..... 131/21, 94, 96; 93/1 C

[56] References Cited

U.S. PATENT DOCUMENTS 3,212,507 10/1965 Schubert ..... 131/21 R 3,404,689 10/1968 Schubert ..... 131/21 R 3,665,930 5/1972 Giatti ..... 131/21 R

*Primary Examiner*—Lawrence Charles

*Attorney, Agent, or Firm*—Craig & Antonelli

[57] ABSTRACT

A filter-attachment machine comprises a drum and a cooperating rolling plate between which assemblies of cigarette and filter portions are rolled in order to wrap connecting sheets around them to join the cigarette portions to the associated filter portions, including means for monitoring the regular passage of assemblies through the rolling area between the drum and the plate and for producing a fault signal when assemblies stop passing a given point in the rolling area at regular predetermined intervals.

7 Claims, 2 Drawing Figures

MANUFACTURE OF FILTER-TIPPED CIGARETTES

Filter-tipped cigarettes commonly made by joining double-length filter portions between axially spaced cigarette portions by means of a connecting sheet (commonly known as a "cork patch") which is rolled around the filter portion and overlaps the ends of the cigarette portions. The machine for doing this is referred to in this content as a "filter-attachment machine".

Filter-attachment machines commonly roll the cork patches around the rod assemblies (each consisting, for example, of two cigarette portions and a double-length filter portion) by means of a stationary rolling plate mounted adjacent to a rolling drum onto which the assemblies and cork patches are fed. Occasionally the completed assemblies fail to pass properly through the rolling area and cause a jam or another adverse condition by which the assemblies become joined to one another by the cork patches. It is then necessary to remove the jam or other adverse condition quickly in order to prevent damage to the machine and/or waste of material. It is usually left to an operator to observe the machine and to switch it off or take other corrective action when he sees such a condition occurring. The present invention is concerned mainly with means for automatically detecting the occurrence of a jam or other such adverse condition and for taking corrective action.

According to the present invention a filter-attachment machine has means for monitoring the regular passage of assemblies through the rolling area between the drum and the plate and for producing a fault signal when assemblies stop passing a given point in the rolling area at regular predetermined intervals, the fault signal being preferably used to initiate automatically corrective action which tends to stop the jam or other adverse condition. For example, the corrective action may consist of stopping the delivery to the drum of cork patches and/or of filter portions.

This invention is particularly concerned with the following simple and effective arrangement for monitoring the passage of assemblies through the rolling area. The rolling drum with a series of ports so arranged that each port in turn is substantially closed momentarily as an assembly rolls past it; and a source of pressure is arranged to communicate with successive ports so that air flows continuously inwards or outwards through a port (depending upon whether the source is above or below atmospheric pressure) except when the port communicating with the pressure source is being closed by an assembly. The regular interruption of the air flow by the passage of assemblies indicates proper operation of the machine, and the monitoring system may include means for detecting when the regular cycle of interrupted air flow ceases. Preferably the flow of air is detected by a pressure detecting device connected to a conduit which carries the air from the source and which includes a restrictor producing a pressure drop when air is flowing through the conduit, so that a pulse of increased pressure is received by the pressure detector whenever a port communicating with the pressure source is closed by an assembly.

Alternatively, there could be a single port in the rolling plate which is closed by successive assemblies.

A preferred machine according to this invention has, at regular intervals around the rolling drum, ports which are supplied with suction to hold the cork patches on the drum, and these ports are supplied briefly with above-atmospheric pressure air while moving past the rolling plate. The flow of air outwards through the ports clears out any dirt from the ports, and this air flow is monitored to detect the regular movement of assemblies past the ports in the rolling area.

An example of a filter attachment machine according to this invention is shown in the accompanying drawings. In these drawings.

Figure 1:
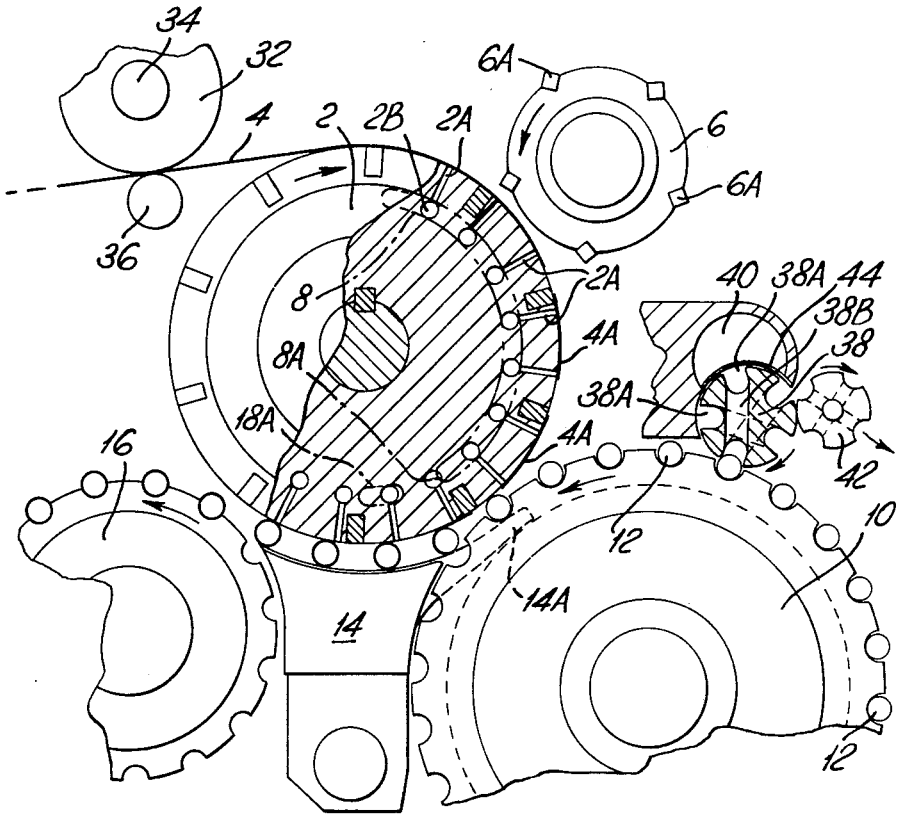
FIG. 1 is a partly sectioned side elevation of part of the machine.

As shown in FIG. 1, the machine includes a rolling drum 2 on to which a continuous web of cork material 4 is fed. A rotary cutting device 6 with peripherally spaced knives 6A cooperates with the rolling drum to cut the cork web into individual cork patches 4A. At regular intervals around the rolling drum there are ports 2A through which suction is applied to hold the cork web 4 taut and then to hold the cork patches on the rolling drum. Suction is supplied to the ports 2A from a slot 8 in a stationary suction supply manifold (not shown) mounted closely adjacent to one end of the rolling drum 2. The slot 8 terminates at position 8A, after which point suction is no longer needed.

It should be understood that the ports 2A are formed at regular intervals along the drum as well as around the drum. That is to say, there are axially extending lines of ports 2A, each line of ports communicating with an axial passageway 2B which opens out at the end of the drum 2 adjacent to the suction supply slot 8.

A fluted drum 10 delivers successive assemblies 12 each consisting of two axially spaced cigarette portions between which there is a double-length filter portion. Fingers 14A on a rolling plate 14 strip the assemblies out of the flutes of the drum 10 and press them against the leading edges of successive cork patches, thus starting the rolling operation by which each cork patch is rolled around the double-length filter portion of the corresponding assembly, overlapping onto the adjacent ends of the cigarette portions so as to form a double filter-tipped cigarette. The assemblies pass through the rolling area between the drum 2 and the rolling plate 14 at regular intervals as shown. They are then received by a further fluted drum 16. Further downstream the assemblies are cut through the middle to form two rows of individual filter-tipped cigarettes.

Figure 2:
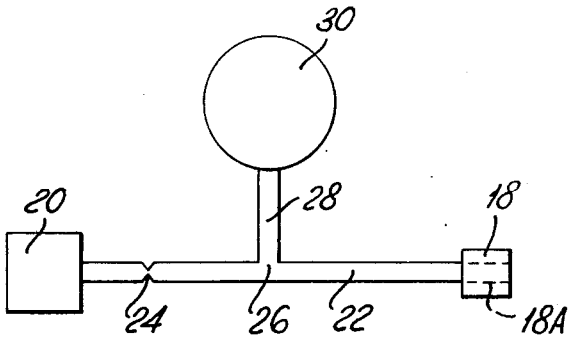
FIG. 2 shows diagrammatically how air is supplied to monitor the passage of assemblies through the rolling area.

At the same end of the drum as the suction supply slot 8, there is a fixed manifold 18 (see FIG. 2) formed with a short slot 18A. Air at above-atmospheric pressure is supplied to the manifold 18 from a source 20. As a result, air blows out through the ports 2A while they are in communication with the slot 18A, except when a port is closed by one of the assemblies 12. A pipe 22 by which air is supplied to the manifold 18 from the source 20 includes a restrictor 24. Downstream of the restrictor 24 there is a junction 26 at which a pipe 28 is connected to the pipe 22, the pipe 28 also being connected to a pressure transducer 30. The transducer 30 emits an electrical signal indicative of the pressure at the junction 26.

As long as the machine is operating normally, a succession of pressure pulses is felt at the junction 26 and results in the emission of a succession of electrical pulses by the transducer 30. The regular occurrence of these pulses may be monitored by a circuit such as that described in British patent specification No. 1,066,056. This circuit may be arranged to emit a fault signal when the pressure pulses cease to occur at regular intervals, and the fault signal may be used to stop the cork feed and/or the filter feed. This will then frequently result in the jam or other adverse condition clearing itself. As soon as the pressure pulses resume, the cork and/or filter feed may be resumed automatically. The circuit may in addition include provision for switching off the entire machine if the fault continues for more than a predetermined time, for example 10 seconds.

The cork may be fed towards the rolling drum 2 by a roller 32 driven by a motor 34, the cork being pressed against the roller 32 by a spring-loaded roller 36. Thus the supply of cork to the drum 2 can be stopped merely by stopping the motor 34.

If it is required to stop the feed of filter portions as well, this may be achieved by means of a suction roller 38. This roller has peripheral flutes 38A which register with the flutes on the supply drum 10; and there are a number of slots 38B which extend through the roller between spaced flutes 38A. In order to remove filter portions (i.e. double-length portions), suction is supplied, when necessary, to a fixed manifold 40 and is transmitted through the slots 38A so that the filter portions are carried off the drum 10 in the flutes of the roller 38 and are then received by a further fluted suction roller 42; filter portions on the roller 38, while passing the manifold 40, are held in the flutes by curved fingers 44. Filter portions received by the roller 42 may be ejected in any convenient way; their removal from the drum 10 by the roller 38 may be assisted by supplying a pulse of compressed air to the drum tending to blow the filter portions radially off the drum.

It should be understood that the peripheral speed of the rolling drum 2 is double that of the drums 10 and 16, the speed of the assemblies being substantially constant. Each alternate port 2A is closed momentarily, so as to stop the flow of air via the slot 18A, as an assembly rolls past it in a backward direction relative to the direction of movement of the port.

The following modification is possible. The pipe 22 shown in FIG. 2 may include a second restrictor between the junction 26 and the manifold 18, with a vent to atmosphere at a point between the two restrictors. The vent and possibly at least one restrictor may be adjustable.

Instead of the arrangement described above, each rod assembly may comprise a cigarette portion and an individual filter portion, and the connecting sheet for each assembly may comprise a narrow strip which encircles the adjacent parts of the cigarette and filter portions, i.e. is not wide enough to enclose the entire filter portion.

Instead of the pneumatic arrangement described above for monitoring the regular passage of assemblies through the rolling area between the drum 2 and the rolling plate 14, it is possible to use, for example, a photo-electric cell towards which a beam of light is directed through the gap between the drum and the rolling plate in a direction parallel to the axis of the drum. By this means, a regular cycle of electrical pulses can be generated as a result of the periodic interruption of the light beam by successive rod assemblies.

We claim:

1. A filter-attachment machine comprising a drum and a cooperating rolling plate between which assemblies of cigarette and filter portions are rolled in order to wrap connecting sheets around them to join the cigarette portions to the associated filter portions, including means for monitoring the regular passage of assemblies through the rolling area between the drum and the plate and for producing a fault signal when assemblies stop passing a given point in the rolling area at regular predetermined intervals.

2. A machine according to claim 1 including means for automatically initiating corrective action in response to the production of a fault signal.

3. A machine according to claim 2 in which the corrective action consists of stopping the delivery to the drum of connecting sheets and/or of filter portions.

4. A filter-attachment machine comprising a drum and a cooperating rolling plate between which assemblies of cigarette and filter portions are rolled in order to wrap connecting sheets around them to join the cigarette portions to the associated filter portions, including means for monitoring the regular passage of assemblies through the rolling area between the drum and the plate and for producing a fault signal when assemblies stop passing a given point in the rolling area at regular predetermined intervals, said monitoring means comprising a series of ports in the drum so arranged that each port in turn is substantially closed momentarily by an assembly rolling past it, a source of pressure which is arranged to communicate with successive ports so that air flows continuously inwards or outwards through a port except when the port communicating with the pressure source is being closed by an assembly, and means for detecting when the regular cycle of periodically interrupted air flow ceases.

5. A machine according to claim 4 in which the air flow is detected by a pressure detecting device connected to a conduit which carries the air from the source and which includes a restrictor producing a pressure drop when air is flowing through the conduit, so that a pulse of increased pressure is received by the pressure detector whenever a port communicating with the pressure source is closed by an assembly.

6. A machine according to claim 4 in which the series of ports communicates initially with a source of suction to hold the connecting sheets on the drum, and in which the first mentioned source is at above-atmospheric pressure so that it also serves to clear out any dirt from the ports.

7. A filter-attachment machine comprising a drum and a cooperating rolling plate between which assemblies of cigarette and filter portions are rolled in order to wrap connecting sheets around them to join the cigarette portions to the associated filter portions, means defining at least one passage opening out in the rolling area between the drum and the rolling plate, a source of pressure, connecting means for connecting the source of pressure to said passage or passages to produce a continuous air flow which is interrupted as successive assemblies pass by, substantially closing the passage or passages, and including means responsive to the air flow through the connecting means for producing a fault signal when the regular cycle of periodically interrupted air flow ceases.

* * * * *